US006357537B1

(12) United States Patent
Runquist et al.

(10) Patent No.: US 6,357,537 B1
(45) Date of Patent: Mar. 19, 2002

(54) DIRECTIONAL DRILLING MACHINE AND METHOD OF DIRECTIONAL DRILLING

(75) Inventors: Randy Runquist, Lovilia; Mark Van Houwelingen, Knoxville, both of IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

(21) Appl. No.: 09/525,408

(22) Filed: Mar. 15, 2000

(51) Int. Cl.[7] ..... E21B 4/06
(52) U.S. Cl. ..... 175/62
(58) Field of Search ..... 175/61, 62, 45, 175/73, 122, 331, 356, 371, 170, 171; 81/57.14, 57.18, 57.35; 173/28, 46, 152

(56) References Cited

U.S. PATENT DOCUMENTS

| | | | |
|---|---|---|---|
| 2,300,016 | A | 10/1942 | Scott et al. |
| 2,324,102 | A | 7/1943 | Miller et al. |
| 2,783,972 | A | 3/1957 | Fehlmann |
| 3,525,405 | A | 8/1970 | Coyne et al. |
| 3,529,682 | A | 9/1970 | Coyne et al. |
| 3,536,151 | A | 10/1970 | Aarup |

FOREIGN PATENT DOCUMENTS

| | | | |
|---|---|---|---|
| EP | 0 209 217 | B1 | 1/1987 |
| EP | 0 467 642 | A2 | 1/1992 |
| JP | 56-64090 | | 6/1981 |
| WO | WO 01/51760 | A2 | 7/2001 |

(List continued on next page.)

*Primary Examiner*—Robert E. Pezzuto
(74) *Attorney, Agent, or Firm*—Merchant & Gould P.C.

(57) ABSTRACT

A horizontal drilling machine for directionally drilling a drill string into the ground. The drill string includes a plurality of elongated members threaded together in an end-to-end relationship. The drilling machine includes a track, a rotational driver mounted on the track, and a thrust mechanism for propelling the rotational driver along the track. The rotational driver is used to rotate the drill string in forward and reverse directions about a longitudinal axis of the drill string. The drill string is rotated in the forward direction to thread the elongated members together, and rotated in the reverse direction to unthread the elongated members from one another. The drilling machine also includes a reverse torque limiter that prevents the rotational driver from applying a reverse torque to the drill string that exceeds a reverse torque limit. The reverse torque limit is less than a maximum reverse torque that can be generated by the rotational driver when the reverse torque limiter is deactivated.

36 Claims, 10 Drawing Sheets

U.S. PATENT DOCUMENTS 3,878,903 A 4/1975 Cherrington
4,144,941 A 3/1979 Ritter
4,262,758 A 4/1981 Evans
4,396,073 A 8/1983 Reichman et al.
4,416,339 A 11/1983 Baker et al.
4,453,603 A 6/1984 Voss et al.
4,632,191 A 12/1986 McDonald et al.
4,637,479 A 1/1987 Leising
4,674,579 A 6/1987 Geller et al.
4,679,637 A 7/1987 Cherrington et al.
4,694,913 A 9/1987 McDonald et al.
4,714,118 A 12/1987 Baker et al.
4,787,463 A 11/1988 Geller et al.
4,823,888 A 4/1989 Smet
4,858,704 A 8/1989 McDonald et al.
4,867,255 A 9/1989 Baker et al.
4,953,638 A 9/1990 Dunn
4,991,667 A 2/1991 Wilkes, Jr. et al.
5,020,608 A 6/1991 Oden et al.
RE33,793 E 1/1992 Cherrington et al.
5,231,899 A * 8/1993 Lee ..... 81/57.16
5,289,887 A 3/1994 Püttmann
5,421,420 A 6/1995 Malone et al.
5,449,046 A 9/1995 Kinnan
5,513,713 A 5/1996 Groves
5,553,678 A 9/1996 Barr et al.
5,556,253 A 9/1996 Rozendaal et al.
5,607,280 A 3/1997 Rozendaal
5,746,278 A 5/1998 Bischel et al.
5,778,991 A 7/1998 Runquist et al.
5,941,320 A 8/1999 Austin et al.
5,941,322 A 8/1999 Stephenson et al.
5,964,306 A * 10/1999 Barbera ..... 175/122
6,085,852 A 7/2000 Sparks et al.
6,109,371 A 8/2000 Kinnan

* cited by examiner

DIRECTIONAL DRILLING MACHINE AND METHOD OF DIRECTIONAL DRILLING

FIELD OF THE INVENTION

The present invention relates generally to underground drilling machines. More particularly, the present invention relates to underground drilling machines for use in horizontal directional drilling.

BACKGROUND OF THE INVENTION

Utility lines for water, electricity, gas, telephone and cable television are often run underground for reasons of safety and aesthetics. Sometimes, the underground utilities can be buried in a trench that is then back filled. However, trenching can be time consuming and can cause substantial damage to existing structures or roadways. Consequently, alternative techniques such as horizontal directional drilling (HDD) are becoming increasingly more popular.

A typical horizontal directional drilling machine includes a frame on which is mounted a drive mechanism that can be slidably moved along the longitudinal axis of the frame. The drive mechanism is adapted to rotate a drill string about its longitudinal axis. Sliding movement of the drive mechanism along the frame, in concert with the rotation of the drill string, causes the drill string to be longitudinally advanced into or withdrawn from the ground.

In a typical horizontal directional drilling sequence, the horizontal directional drilling machine drills a hole into the ground at an oblique angle with respect to the ground surface. During drilling, drilling fluid can be pumped through the drill string, over a drill head (e.g., a cutting or boring tool) at the end of the drill string, and back up through the hole to remove cuttings and dirt. After the drill head reaches a desired depth, the drill head is then directed along a substantially horizontal path to create a horizontal hole. After the desired length of hole has been drilled, the drill head is then directed upwards to break through the ground surface. A reamer is then attached to the drill string which is pulled back through the hole, thus reaming out the hole to a larger diameter. It is common to attach a utility line or other conduit to the drill string so that it is dragged through the hole along with the reamer.

To drill relatively long holes, it is common to use drill strings having many interconnected lengths of drill pipe. The individual pieces of pipe are typically threaded together to form the drill string. When two drill pipes are threaded together, they are torqued to a predetermined torque (i.e., the makeup torque) to provide a secure connection. During drilling operations, the drill string is typically rotated in a forward direction (e.g., clockwise). Thus, assuming the pipes have right-hand threads, the forward rotation of the drill string encourages the pipes to remain threaded together. However, at times it is desirable to rotate the drill string in a reverse direction (e.g., counterclockwise). During this reverse rotation, the drill pipes are encouraged to become uncoupled. This is particularly true if the drill head of the drill string becomes wedged in hard soil or rock. If two of the drill pipes become uncoupled, a gap is formed in the threaded joint between the pipes that allows foreign matter to enter the joint. Until the foreign matter is removed, the matter can prevent the joint from being sufficiently retorqued. The loose joint will not be able to carry any reverse rotational torque load unless it is retorqued. If the uncoupling occurs underground, it may be difficult to identify that a joint has become loose and the operation and/or steering of the horizontal directional drilling machine can be negatively effected.

SUMMARY OF THE INVENTION

One aspect of the present invention relates to a horizontal drilling machine for directionally drilling a drill string into the ground. The drill string includes a plurality of elongated members threaded together in an end-to-end relationship. The drilling machine includes a track, and a rotational driver for rotating the drill string in forward and reverse directions about a longitudinal axis of the drill string. The drill string is rotated in the forward direction to thread the elongated members together. The drill string is rotated in the reverse direction to unthread the elongated members from one another. The drilling machine further includes a thrust mechanism for propelling the rotational driver along the track, and a reverse torque limiter that prevents the rotational driver from applying a reverse torque to the drill string that exceeds a reverse torque limit. The reverse torque limit is less than a maximum reverse torque that can be generated by the rotational driver, and is preferably less than a break-out torque required to uncouple the elongated members. In certain embodiments, a forward torque limiter can be used in combination with the reverse torque limiter.

Another aspect of the present invention relates to a horizontal drilling machine having a thrust limiter that can be activated and deactivated by an operator of the drilling machine depending upon drilling conditions encountered by the operator.

A further aspect of the present invention relates to a method for directionally drilling a drill string into the ground. The drill string including a plurality of elongated members. The method includes threading the elongated members together by applying forward torque to the elongated members, and pushing the drill string into the ground. The method also includes rotating the drill string in forward and reverse directions by applying forward and reverse torque to the drill string in an alternating fashion while thrust concurrently is applied to the drill string. The method further includes automatically limiting the reverse torque applied to the drill string to a value less than a break out torque required to uncouple the elongated members.

Still another aspect of the present invention relates to another method for directionally drilling a drill string into the ground. The method includes activating a reverse rotation torque limiter, and pushing the drill string into the ground. The method also includes rotating the underground drill string in forward and reverse directions by applying forward and reverse torque to the drill string in an alternating fashion while the reverse rotation torque limiter is concurrently activated. The reverse rotation torque limiter limits the reverse torque applied to the drill string to a value less than a break out torque required to uncouple the elongated members.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawing figures in which identical elements are numbered identically throughout, a description of various exemplary aspects of the present invention will now be provided.

I. Description of a Representative Embodiment

Figure 1:
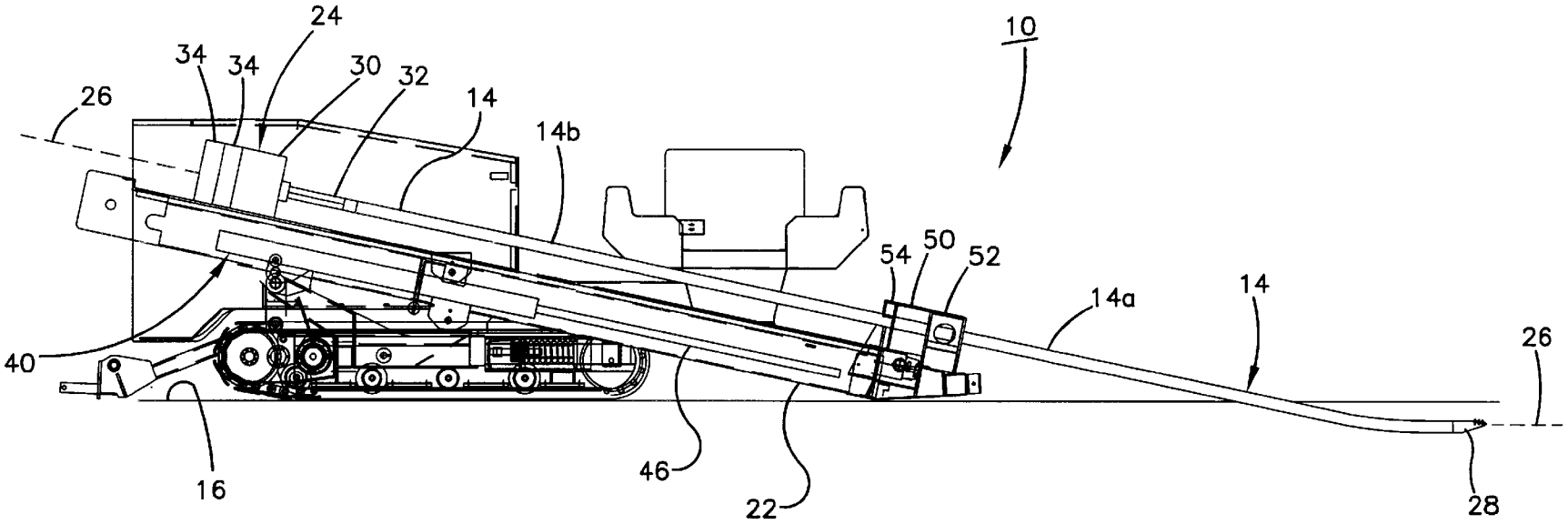
FIG. 1 shows a horizontal directional drilling machine constructed in accordance with the principles of the present invention.
Figure 2:
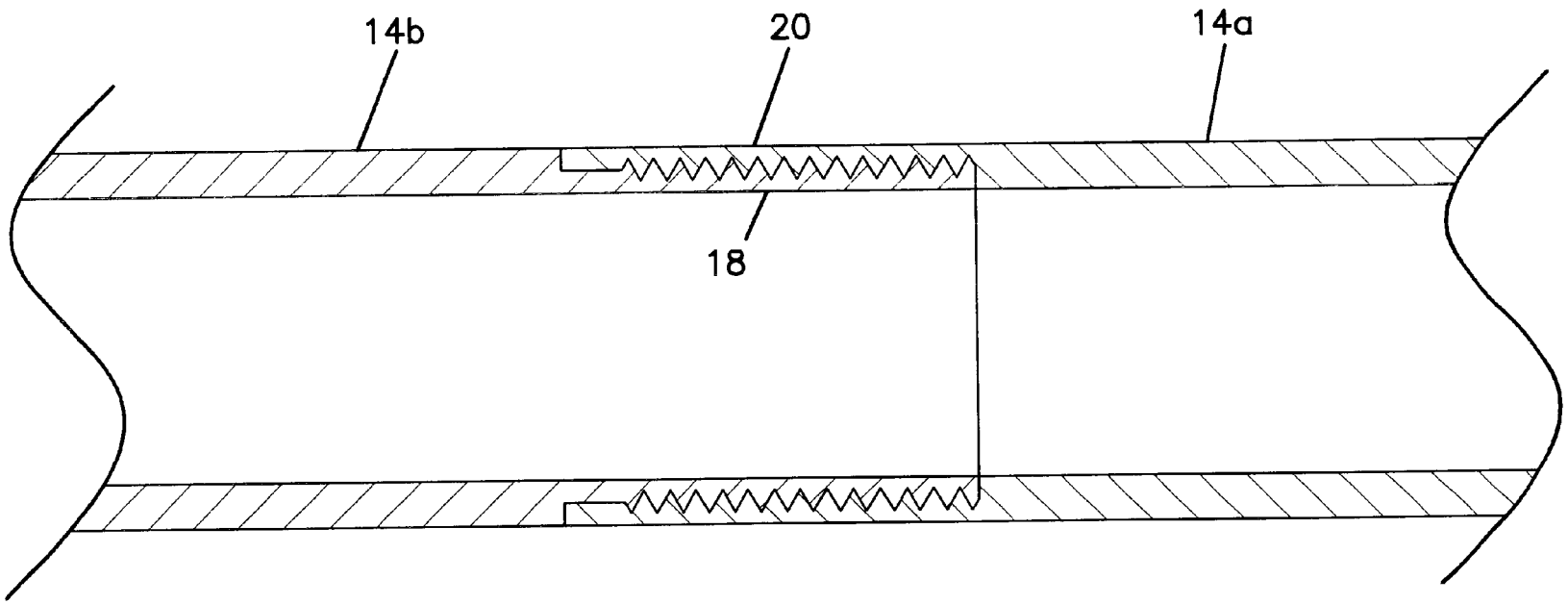
FIG. 2 shows a threaded connection formed between two elongated members that form the drill string shown in FIG. 1.

FIG. 1 illustrates a directional drilling machine 10 constructed in accordance with the principles of the present invention. The drilling machine 10 is adapted for pushing a drill string 14 into the ground 16, and for pulling the drill string 14 from the ground 16. The drill string 14 includes a plurality of elongated members 14*a* and 14*b* (e.g., rods, pipes, etc.) that are connected in an end-to-end relationship. A drill head 28 is preferably mounted at the far end of the drill string 14 to facilitate driving the drill string 14 into the ground 16. The dill head 28 can include, for example, a cutting bit assembly, a starter rod, a fluid hammer, a sonde holder, as well as other components. Preferably, each of the elongated members 14*a* and 14*b* includes a threaded male end 18 (shown in FIG. 2) positioned opposite from a threaded female end 20 (shown in FIG. 2). To couple the elongated members 14*a* and 14*b* together, the male end 18 of the elongated members 14*a* is threaded into the female end 20 of the elongated member 14*b* to provide a threaded coupling or joint.

Referring back to FIG. 1, the directional drilling machine 10 includes an elongated guide or track 22 that can be positioned by an operator at any number of different oblique angles relative to the ground 16. A rotational driver 24 is mounted on the track 22. The rotational driver 24 is adapted for rotating the drill string 14 in forward and reverse directions about a longitudinal axis 26 of the drill string 14. As used herein, the terms "forward direction" or "forward torque" are intended to mean that the drill string is rotated in a direction that encourages the elongated members 14*a* and 14*b* to thread together. For example, if the elongated members 14*a* and 14*b* have right-hand threads, the forward direction of rotation or torque is in a clockwise direction. By contrast, the terms "reverse direction" or "reverse torque" are intended to mean that the drill string is rotated in a direction that encourages the elongated members 14*a* and 14*b* to unthread from one another. For example, if the elongated members 14*a* and 14*b* include right-hand threads, the reverse direction or reverse torque is oriented in a counterclockwise direction.

As shown in FIG. 1, the rotational driver 24 includes a gear box 30 having an output shaft 32 (i.e., a drive chuck or a drive shaft). The gear box 30 is powered by one or more hydraulic motors 34. As depicted in FIG. 1, two hydraulic motors 34 are provided. However, it will be appreciated that more or fewer motors 34 can be coupled to the gear box 30 depending upon the amount of torque that is desired to be generated by the rotational driver 24. While a hydraulic system has been shown, it will be appreciated that any number of different types of devices known for generating torque could be utilized. For example, in alternative embodiments, an engine such as an internal combustion engine could be used to provide torque to the drill string 14.

The rotational driver 24 is adapted to slide longitudinally up and down the track 22. For example, the rotational driver 24 can be mounted on a carriage (not shown) that slidably rides on rails (not shown) of the track 22 as shown in U.S. Pat. No. 5,941,320 that is hereby incorporated by reference. A thrust mechanism 40 is provided for propelling the rotational driver 24 along the track 22. For example, the thrust mechanism 40 moves the rotational driver 24 in a downward direction (indicated by arrow 42) to push the drill string 14 into the ground 16. By contrast, the thrust mechanism propels the rotational driver 24 in an upward direction (indicated by arrow 44) to remove the drill string 14 from the ground 16. It will be appreciated that the thrust mechanism 40 can have any number of known configurations. As shown in FIG. 1, the thrust mechanism 40 includes a hydraulic cylinder 46 that extends along the track 22. The hydraulic cylinder 46 is coupled to the rotational driver 24 by a chain drive assembly (not shown). Preferably, the chain drive assembly includes a chain that is entrained around pulleys or gears in a block and tackle arrangement such that an incremental stroke of the hydraulic cylinder 46 results in an increased displacement of the rotational driver 24. For example, in one particular embodiment, the chain drive assembly displaces the rotational driver 24 a distance equal to about twice the stroke length of the hydraulic cylinder 46. Directional drilling machines having a chain drive arrangement as described above are well known in the art. For example, such chain drive arrangements are used on numerous directional drilling machines manufactured by Vermeer Manufacturing Company of Pella, Iowa.

While one particular thrust arrangement for moving the rotational driver 24 has been described above, the present invention contemplates that any number of different configurations can be used. For example, one or more hydraulic cylinders can be coupled directly to the rotational driver 24. Alternatively, a rack and pinion arrangement could also be used to move the rotational driver 24. Furthermore, a combustion engine or simple chain or belt drive arrangements, which do not use hydraulic cylinders, could also be used.

Referring still to FIG. 1, the drilling machine 10 further includes upper and lower gripping units 50 and 52 for use in coupling and uncoupling the elongated members 14*a* and 14*b* of the drill string 14. The upper gripping unit 50 includes a drive mechanism 54 (e.g., a hydraulic cylinder) for rotating the upper gripping unit 50 about the longitudinal axis 26 of the drill string 14. The gripping units 50 and 52 can include any number of configurations adapted for selectively preventing rotation of gripped ones of the elongated members 14*a* and 14*b*. For example, the gripping units 50 and 52 can be configured as vice grips that when closed grip the drill string 14 with sufficient force to prevent the drill string 14 from being rotated by the rotational driver 24. Alternatively, the gripping units 50 and 52 can include wrenches that selectively engage flats provided on the elongated members 14*a* and 14*b* to prevent the elongated members from rotating.

II. Description of Representative Thrust Sequence

To propel the drill string 14 into the ground 16, the rotational driver 24 is positioned at an uppermost location (shown in FIG. 1), and the drill head 28 is gripped within the lower gripping unit 52. The elongated member 14*a* is then placed in axial alignment with the output shaft 32 of the rotational driver 24 and the drill head 28. Once alignment has been achieved, the rotational driver 24 rotates the output shaft 32 in a forward direction. This causes the shaft 32 to thread into the female threaded end 20 of the elongated member 14*a*, and the male threaded end of the elongated member 14*a* to concurrently thread into the female threaded end of the drill head 28. The drill head 28 is prevented from rotating by the gripping unit 52. During the threading process, the rotational driver 24 advances downward to ensure that the lower end of the elongated member 14*a* contacts the drill head 28 and the upper end of the elongated member 14*a* contacts the output shaft 32. Preferably, the forward torque provided by the rotational driver 24 is limited by a torque limiter to ensure that the drive shaft 32 exceed a predetermined torque. The forward torque used to provide the threaded connection between the drive shaft 32 and the elongated member 14*a* is called the "make-up torque." The make-up torque is preferably about 67% of the maximum forward torque that the rotational driver 24 can provide when the torque limiter is not active. It will be appreciated that the magnitude of the make-up torque is dependent upon the diameter or size of the elongated members being used. For example, for a 2.375 inch diameter pipe, a make-up torque of about 2400 ft-lb would preferably be used. The make-up torque would be larger for a larger diameter pipe, and lower for a smaller diameter pipe. For example, the make-up torque for a 3.5 inch diameter pipe is preferably about 6000 ft-lb, and the make-up torque for a 1.9 inch diameter pipe is preferably about 1200 ft-lb.

After the first elongated member 14*a* has been coupled to the drive shaft 32 and the drill head 28, the lower gripping unit 52 releases the elongated member 14*a* and the rotational driver 24 is propelled in a downward direction along the track 22 such that the elongated member 14*a* is pushed into the ground 16. As the elongated member 14*a* is pushed into the ground 16, the rotational driver 24 preferably rotates the elongated member 14*a* such that the drill head 28 provides a boring or drilling action. After the elongated member 14*a* has been fully pushed into the ground 16, the trailing end of the elongated member 14*a* is gripped by the lower gripping unit 52 to prevent rotation of the elongated member 14*a*. Once the trailing end of the elongated member 14*a* has been gripped by the lower gripping unit 52, the rotational driver 24 applies a reverse torque to the drive shaft 32 to break the joint formed between the drive shaft 32 and the elongated member 14*a*. By way of example, the reverse torque needed to break the joint can be in the range of 50 to 70% of the make-up torque. The torque used to break a joint can be referred to as the "break-out torque." Thus, when it is desired to break a joint, the reverse torque that can be provided by the rotational driver 34 is preferably not limited so that sufficient torque to break the joint can be provided.

Once the joint has been broken, the drive shaft 32 is completely unthreaded from the elongated member 14*a*, and the rotational driver 24 is moved upward along the track 22 to the uppermost position (e.g., the position shown in FIG. 1). Next, the elongated member 14*b* is placed in alignment with the elongated member 14*a* and the drive shaft 32, and the sequence described above is repeated. Thereafter, depending upon the length of the hole it is desired to drill, additional elongated members can be added to the drill string in the same manner described above.

III. Representative Drill String Steering Technique

As the drill string 14 is pushed into the ground 16, the drill string 14 is preferably steered so as to generally follow a path that has been predetermined by the operator. Commonly, the drill head includes an active sonde (e.g., a device capable of generating a magnetic field) that can be tracked by a locator provided at the ground surface to determine the location of the drill string 14 underground.

One aspect of the present invention relates to a steering technique involving rocking or oscillating the drill head 28 back and forth (e.g., the drill string 14 and the attached drill head 28 are rotated back and forth in the forward and reverse directions). Preferably, the drill head is rocked back and forth along a limited arc (e.g., an arc less than 360 degrees such as a 180 degree arc or a 90 degree arc) while the drill string 14 is concurrently thrust into the ground by the thrust mechanism 40. This results in a steering technique that provides a cutting action during both the forward rotation of the drill head 28 and the reverse rotation of the drill head 28. During the steering action, a thrust limiter can be used to control the thrust output provided by the thrust mechanism 40 such that the thrust provided to the drill string 14 does not exceed a preset thrust pressure limit.

When the drill head 28 is rotated in the forward direction (e.g., in the same direction as the thread leads of the elongated members 14*a* and 14*b*), no problems are encountered because the threaded joints are tightened by the forward rotation. However, when the drill string 14 is rotated in the reverse direction while forward thrust is applied to the drill string 14, the break-out torque of the threaded joints can be exceeded thereby causing one or more of the threaded joints to become loosened or uncoupled.

To overcome the above identified problem, the present invention automatically limits the reverse rotational torque provided by the rotational driver 24 to a value less than the break-out torque value. In other words, during steering, a torque limiting device limits the amount of reverse rotational torque that the rotational driver 24 can provide to a value less than the maximum reverse rotational torque that can be provided by the rotational driver 24 when the torque limiter is not activated. In certain embodiments, the reverse rotational torque can be limited so as to not exceed 50% of the make-up torque. Preferably, the reverse rotational torque is limited so as to not exceed 60% of the make-up torque. In another embodiment, the reverse rotational torque during drilling is limited to 10 to 60% of the make-up torque.

IV. Representative Pull-Back Sequence

To withdraw the drill string 14 from the ground 16, the rotational driver 24 is moved upward along the track 22 from the lowermost position to the uppermost position. As the rotational driver 24 moves upward, the elongated member 14*b* is pulled from the ground 16. When the rotational driver 24 reaches the uppermost position, the elongated member 14*a* is gripped by the lower gripping unit 52, and the elongated member 14*b* is gripped by the upper gripping unit 50. Thereafter, the upper gripping unit 50 is rotated about the longitudinal axis 26 by the drive 54 to break the threaded joint between the two elongated members 14*a* and 14*b*. Once the joint has been broken, the upper gripping unit 50 is released and the rotational driver 24 applies reverse torque to the elongated member 14*b* to completely unthread the elongated member 14*b* from the elongated member 14*a*. During the unthreading process, the rotational driver 24 moves upward. After the two members 14*a* and 14*b* have been uncoupled, the rotational driver 24 moves further upward to separate the members 14*a* and 14*b*. Thereafter, the elongated member 14*b* is again gripped with the upper gripping unit 50 to prevent rotation of the elongated member 14*b*. As the elongated member 14*b* is held by the upper gripping unit 50, the rotational driver 24 applies full reverse torque to the elongated member 14*b* such that the threaded joint between the drive shaft 32 and the elongated member 14*b* is broken and completely unthreaded. During this unthreading process, the rotational driver 24 moves further upward. After the shaft 32 and the member 14*b* have been uncoupled, the rotational driver 24 moves still further upward to separate shaft 32 from the member 14*b*. Once separation has been provided, the elongated member 14*b* is removed from the drilling machine 10, and the rotational driver 24 is returned to the lowermost position.

At the lowermost position, the drive shaft 32 is threaded into the elongated member 14*a* to provide a threaded connection thereinbetween. During the threading process, the lower gripping unit 52 prevents the elongated member 14*a* from rotating. Preferably, in providing such connection, the torque provided by the rotational driver 24 is equal to the make-up torque. After the connection is made, the lower gripping unit 52 is released and the rotational driver 24 is moved along the track 22 from the lowermost position to the uppermost position such that the elongated member 14*a* is withdrawn from the ground 16. The upper clamping unit 50 is then activated to engage the elongated member 14*a*, and the lower gripping unit 52 is activated to grip the drill head 28. Subsequently, the upper clamping unit 50 is rotated to break the connection between the drill head 28 and the member 14*a*. Thereafter, the member 14*a* is uncoupled from the drill head 28 and the output shaft 32 in the same manner described above with respect to the elongated member 14*b*.

V. Representative Torque Limiting Configurations

Figure 3A:
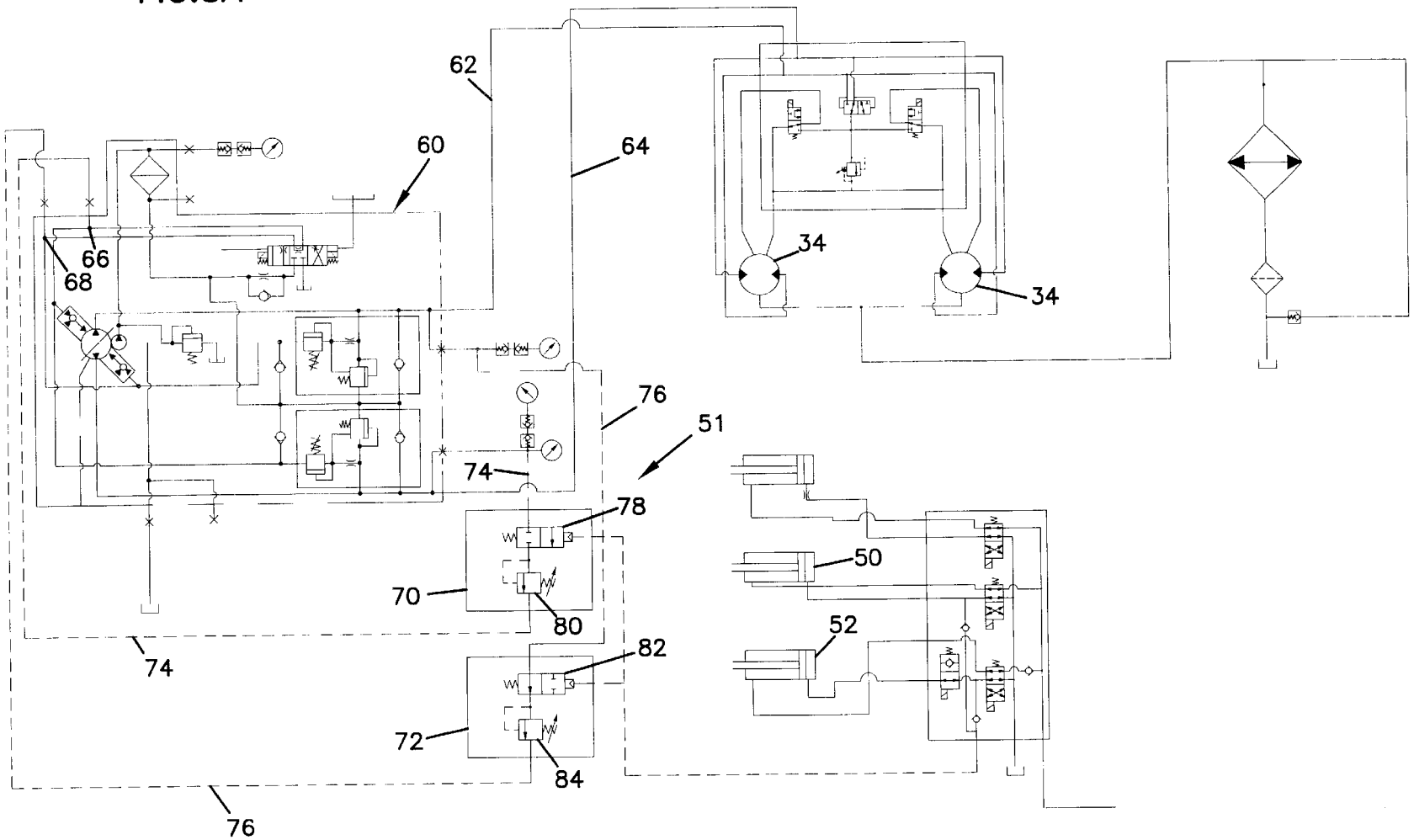
FIG. 3*a* is a schematic diagram of a torque limiting device constructed in accordance with the principles of the present invention, a forward torque limiter is shown deactivated and a reverse torque limiter is shown activated.
Figure 3B:
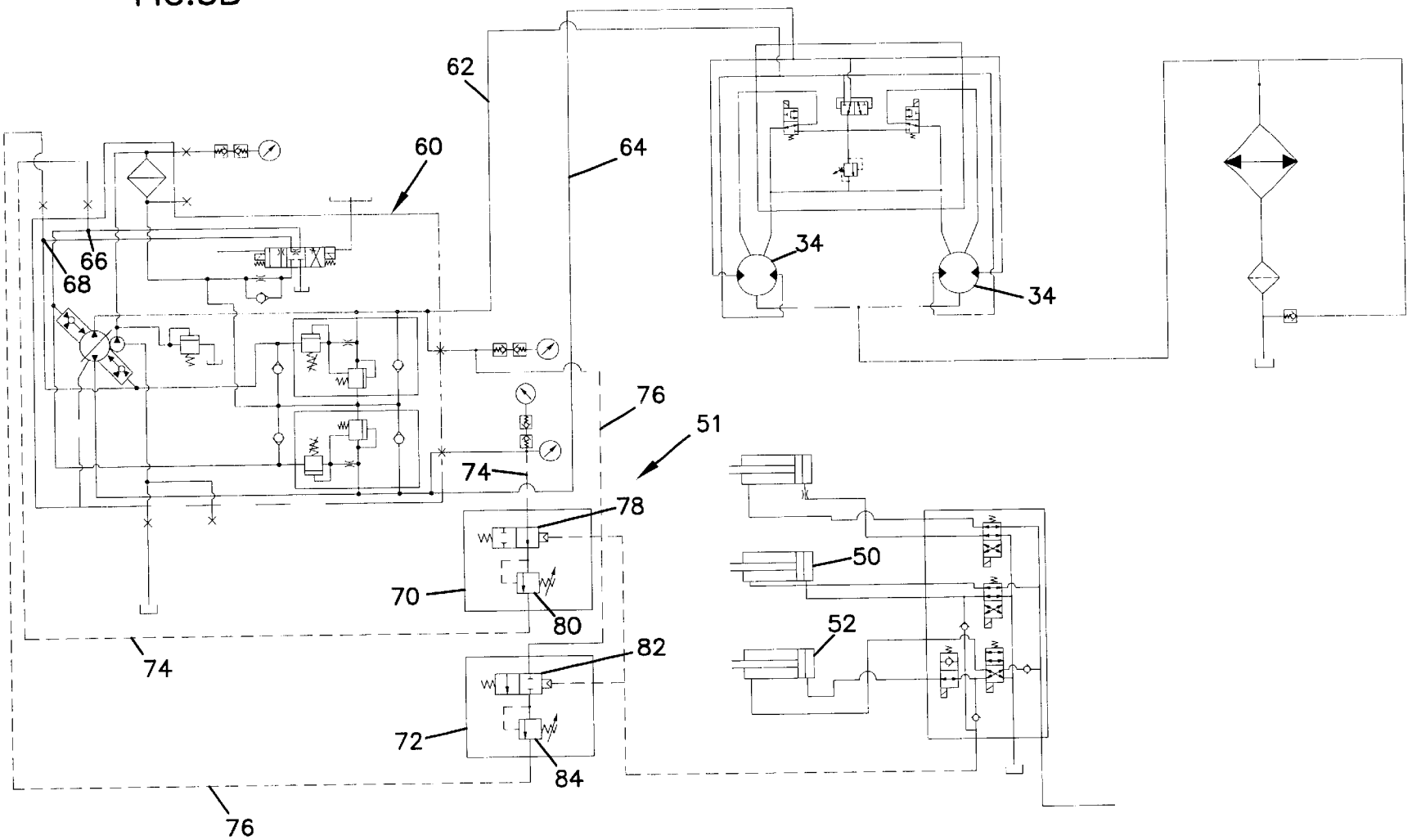
FIG. 3*b* is the torque limiting configuration of FIG. 3*a* with the forward torque limiter activated and the reverse torque limiter deactivated.

FIGS. 3*a* and 3*b* show a torque limiting arrangement 51 constructed in accordance with the principles of the present invention. The system shows many of the same components previously described with respect to FIG. 1. For example, the system shows the motors 34 for powering the rotational driver 24. The system also shows the lower gripping unit 52, the upper gripping unit 50 and the drive mechanism 54 for pivoting the upper gripping unit 50.

As shown in FIGS. 3*a* and 3*b*, the system includes a standard pump 60 for powering the motors 34. A suitable pump for practicing the present invention is a reversible, variable volume hydraulic pump such as those that are sold under model number 90 series by Sauer Sunstrand Company of Ames, Iowa.

Fluid communication between the pump 60 and the motors 34 is provided by a reverse rotational torque pressure line 62 and a forward rotational torque pressure line 64. To rotate the drive shaft 32 in the reverse direction, hydraulic fluid from the pump 60 is outputted through the reverse rotational torque pressure line 62 to the motors 34, and is returned from the motors 34 to the pump 60 through the forward rotational torque pressure line 64. To rotate the drive shaft 32 in the forward direction, hydraulic fluid from the pump 60 is outputted through the forward rotational torque pressure line 64 to the motors 34, and is returned from the motors to the pump through the reverse rotational torque pressure line 62.

The pump 60 is equipped with a first destroke port 66 that corresponds to the forward rotational torque pressure line 64, and a second destroke port 68 that corresponds to the reverse rotational torque pressure line 62. The destroke ports 66, 68 restrict the pump's output when pressure is applied to the destroke ports 66 and 68. For example, if a pressure is applied to the destroke port 66, the pump is configured to reduce its output flow to the forward rotational torque pressure line 64. Similarly, if a pressure is applied to the destroke port 68, the pump will reduce its output flow to the reverse rotational torque pressure line 62. When pressure is not applied to the ports 66 and 68, or when the pressure applied to the ports 66 and 68 is below a predetermined level, the pump 60 will progressively increase its pressure output until: (1) the maximum pressure output of the pump 60 is reached; or (2) a limiting pressure is applied to either one of the destroke ports 66 and 68.

The system of FIGS. 3*a* and 3*b* further includes a forward torque limiter 70 and a reverse torque limiter 72. The forward torque limiter 70 is positioned along a pressure line 74 that extends from the forward rotational torque pressure line 64 to the destroke port 66. The reverse torque limiter 72 is positioned along a pressure line 76 that extends from the reverse rotational torque pressure line 62 to the destroke port 68. The forward torque limiter 70 includes a normally closed solenoid valve 78 positioned upstream from a relief valve 80. The reverse torque limiter 72 includes a normally open solenoid valve 82 positioned upstream from a relief valve 84.

The solenoid valves 78 and 82 are pilot activated. For example, the valves are activated by hydraulic pressure conveyed from the hydraulic circuit for the gripping units 50 and 52. For example, pressure line 86 extends from the circuit for the gripping units 50, 52 to the solenoid valves 78 and 82. When neither of the gripping units 50, 52 have been actuated so as to grip an elongated member, the solenoid valves 78 and 82 remain in their normal positions (e.g., the valve 78 is closed and the valve 82 is open as shown in FIG. 3*a*). By contrast, when either one or both of the gripping units 50, 52 are activated so as to grip an elongated member (as shown in FIG. 3*b*), pressure from the gripping unit circuit travels through pressure line 86 to actuate the solenoid valves 78 and 82. As shown in FIG. 3*b*, when the valves 78 and 82 are actuated, valve 78 is open and valve 82 is closed.

The relief valves 80 and 84 allow an operator to set pressure limits on the output of the pump 60. By limiting the pressure of the pump output, the torque provided by the rotational driver 24 is also limited. In a non-limiting embodiment for use with a 2⅜ inch diameter elongated member, the relief valve 80 can be set to about 4000 psi, and the relief valve 84 can be set to about 1500 psi. It will be appreciated that the pressure values of the valves 80 and 84 can be mechanically adjusted by adjusting spring tension, or electronically adjusted with a pulse width modulated technique.

When the forward torque limiter 70 is activated as shown in FIG. 3*b*, the forward torque limiter limits the pressure the pump 60 can output to the forward rotation torque pressure line 64 to a value set by the relief valve 80. For example, with the relief valve 80 set to a value of 4000 psi, the pump 60 can pressurize the forward rotation torque pressure line 64 up until 4000 psi. When this limit is reached, the relief valve 80 opens thereby allowing the peak level pressure to be applied to the destroke port 66 through the pressure line 74. With the limit pressure being applied to the destroke port 66, the pump 60 is prevented from exceeding this pressure limit.

It will be appreciated that the forward torque limiter 70 is normally off. Thus, during normal drilling operations, the forward torque that can be provided by the rotational driver 24 is only limited by the maximum capacity of the pump 60. However, when either one or both of the gripping units 50, 52 are activated, the forward torque limiter 70 is concurrently activated. Therefore, when an elongated member is gripped to provide a threaded connection between two pipes, the forward torque limiter 70 is automatically activated such that the make-up torque applied to the elongated members is limited by the pressure ceiling set by the relief valve 80.

The reverse torque limiter 72 is in fluid communication with the reverse rotational torque pressure line 62. When the reverse torque limiter 72 is on, the torque limiter 72 limits the pressure that is supplied to the pressure line 62 by the pump 60. The pressure limit is set by adjusting the relief valve 84. In one non-limiting embodiment suitable for use with elongated members having a diameter of 2¾ inches, the relief valve 84 can be set to a pressure of 1500 psi. With the reverse torque limiter activated, the reverse torque limiter 72 prevents the pump from supplying a pressure to the reverse rotational torque line 62 that exceeds the pressure value set by the valve 84. If the pressure provided to the pressure line 62 by the pump 60 reaches the preset pressure limit, the relief valve 84 opens such that the pressure in the pressure line 62 is applied to the destroke port 68. By applying this pressure to the destroke port 68, the pressure output by the pump 60 to the pressure line 62 is limited by the value set at the relief valve 84.

During normal drilling operations, the reverse torque limiter 72 is active such that the reverse torque that can be provided by the rotational driver 24 is limited by the value set at the relief valve 84. Preferably, the pressure set at the relief valve 84 corresponds to a reverse torque value that is less than the break-out torque value required to uncouple two of the threaded elongated members. Thus, when the drill string is rocked back and forth to achieve a desired steering effect, the rotational driver 24 is automatically prevented from applying a reverse torque to the drill string that is sufficient to break loose any of the joints of the drill string. This is true even if the drill head 28 gets hung up during a reverse sequence.

When the lower gripping unit 52 is used to grip an elongated member as shown in FIG. 3*b*, the reverse torque limiter 72 automatically is deactivated. Thus, when an operator grips a pipe for the purpose of breaking a joint, the pump 60 provides sufficient pressure to the motors 34 to generate a torque that equals or exceeds the break-out torque required to break the joint.

Figure 4A:
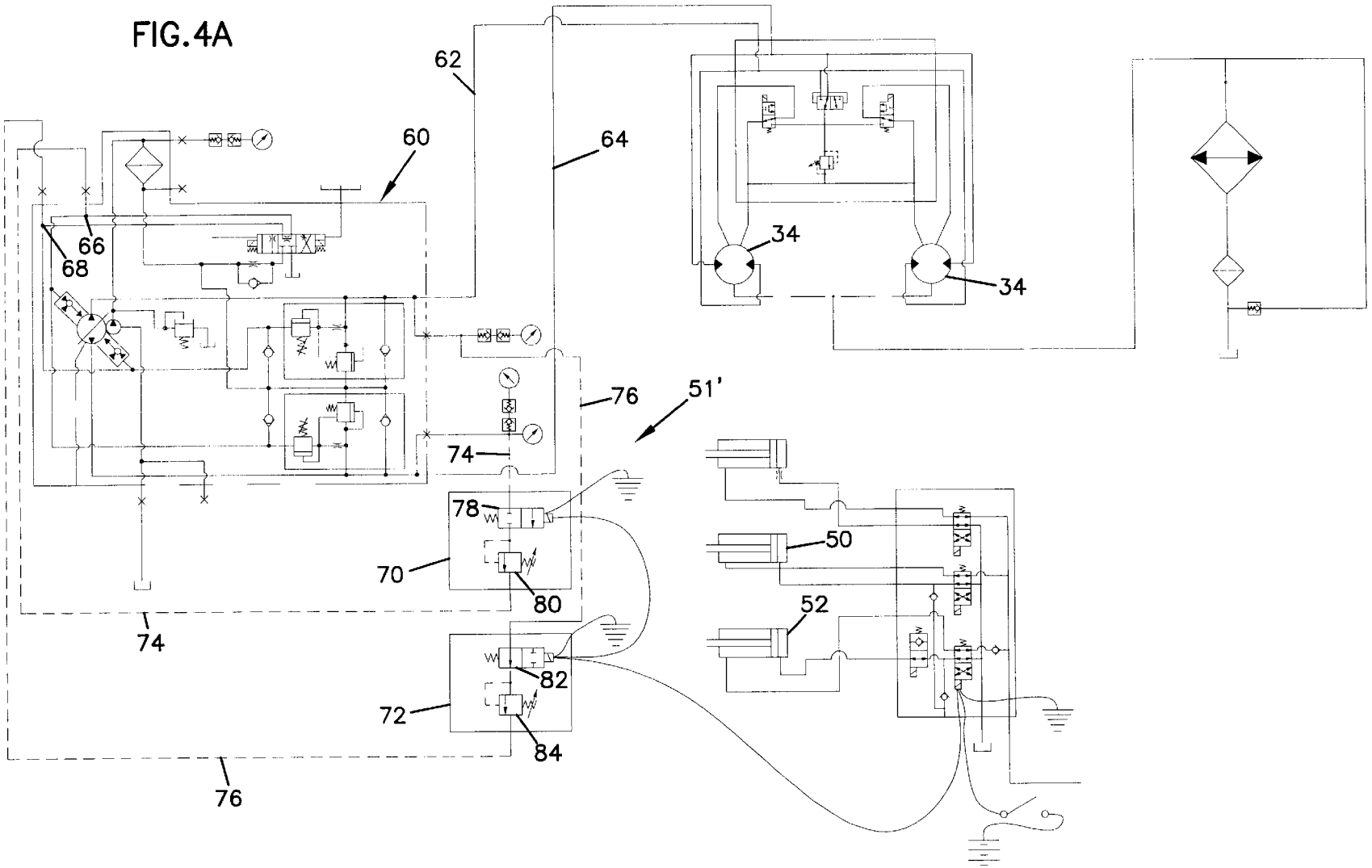
FIG. 4*a* is an alternative torque limiting configuration constructed in accordance with the principles of the present invention, the forward torque limiter is shown deactivated and the reverse torque limiter is shown activated.
Figure 4B:
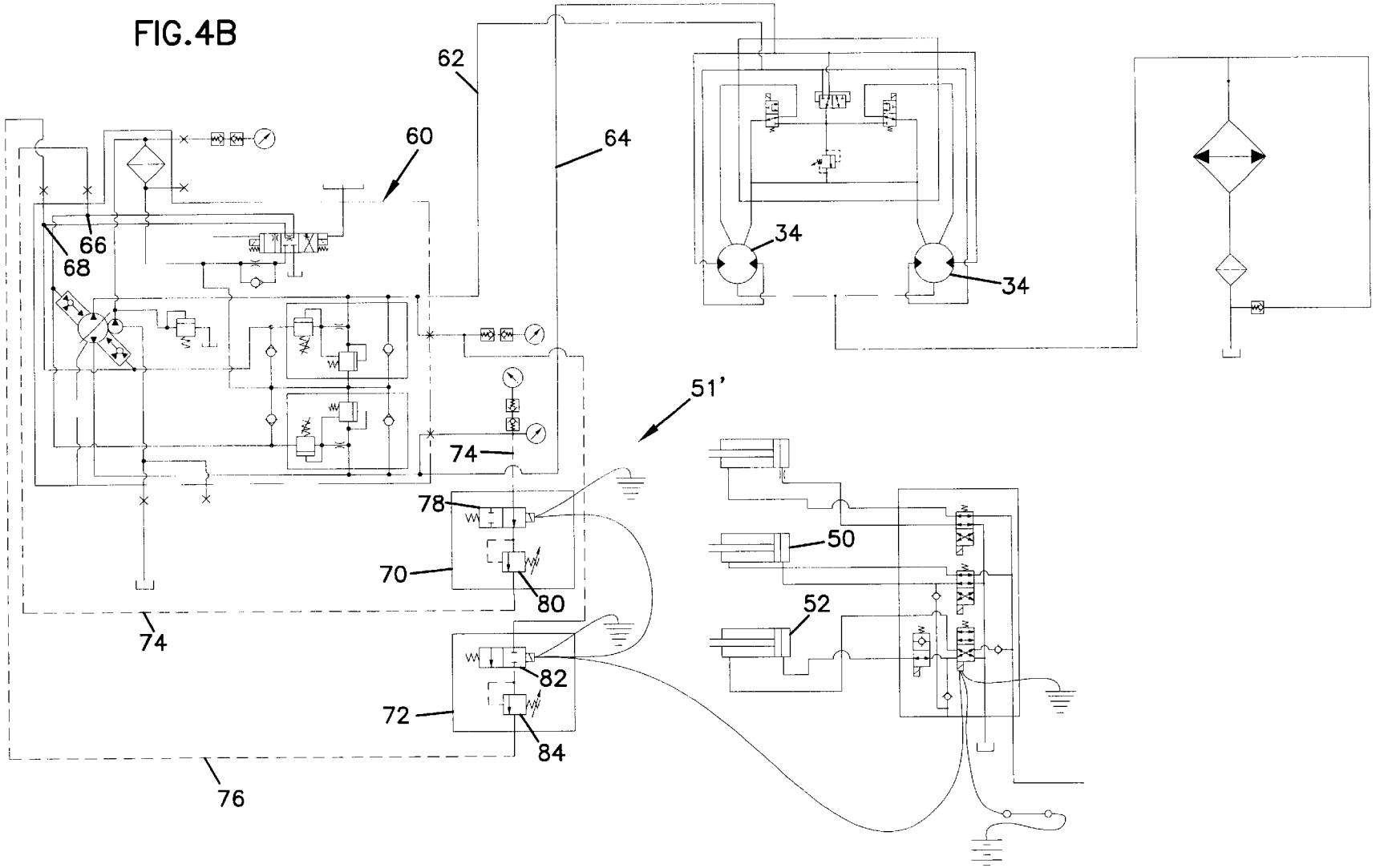
FIG. 4*b* is the torque limiting configuration of FIG. 4*a* with the forward torque limiter activated and the reverse torque limiter deactivated.

FIGS. 4*a* and 4*b* illustrate an alternative torque limiting arrangement 51' having the same components as the arrangement 51 of FIGS. 3*a* and 3*b* except that the solenoids 78 and 82 are electronically actuated when the gripping unit 52 is used to grip an elongated member. FIG. 4*a* shows the gripping unit 52 in a non-gripping orientation. Hence, the solenoid valve 78 of the forward torque limiter 70 is deactivated, and the solenoid 82 of the reverse torque limiter 72 is activated. FIG. 4*b* shows the lower gripping unit 52 being hydraulically pressurized such that the lower gripping unit 52 is caused to move to an orientation where it can grip an elongated member. With the lower gripping unit 52 so activated, the forward torque limiter 70 is electronically activated and the reverse torque limiter 72 is electronically deactivated.

VI. Representative Thrust Limiting Configuration

Figure 5A:
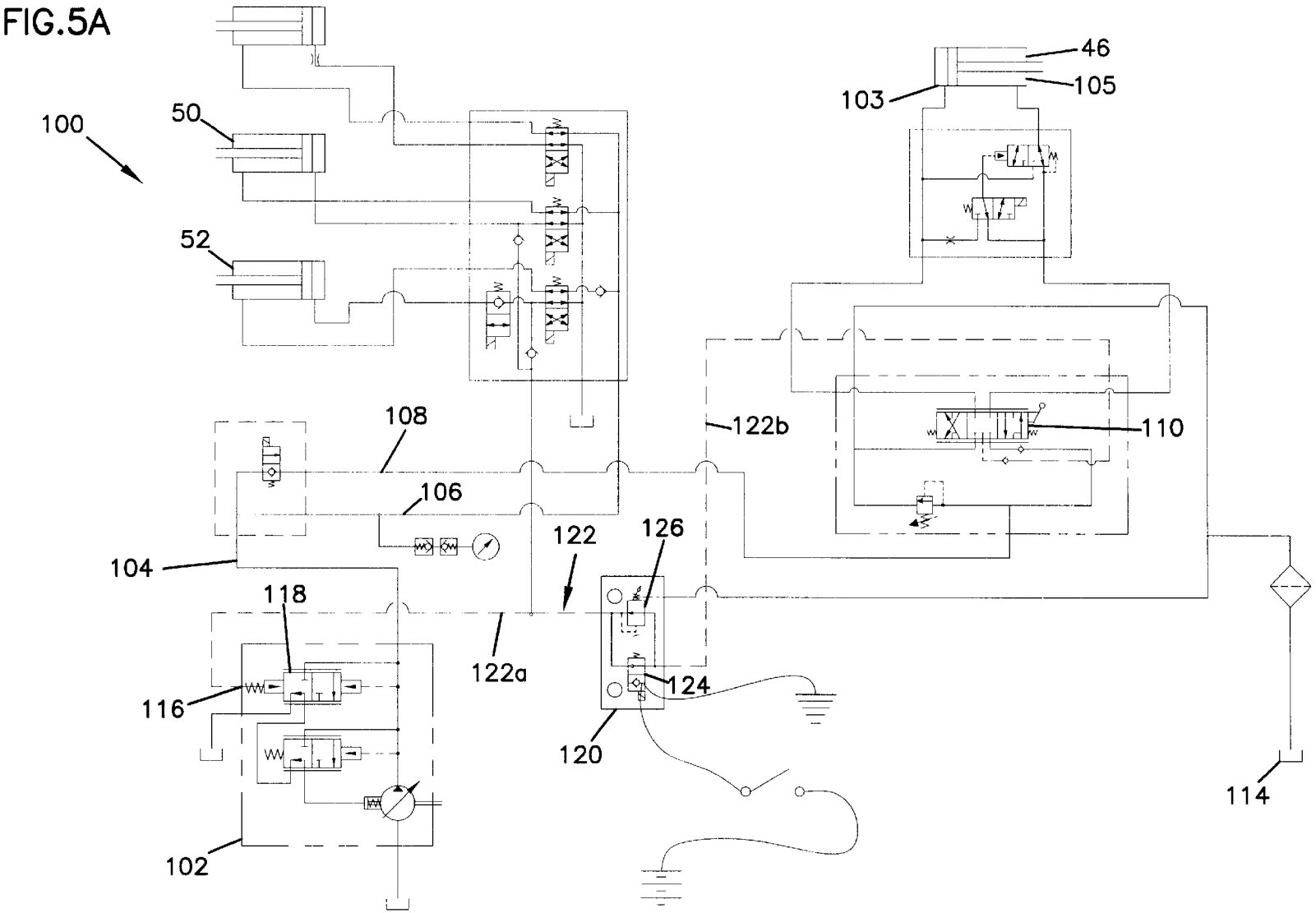
FIG. 5*a* is a thrust limiting configuration constructed in accordance with the principles of the present invention, the thrust limiter is shown deactivated.
Figure 5B:
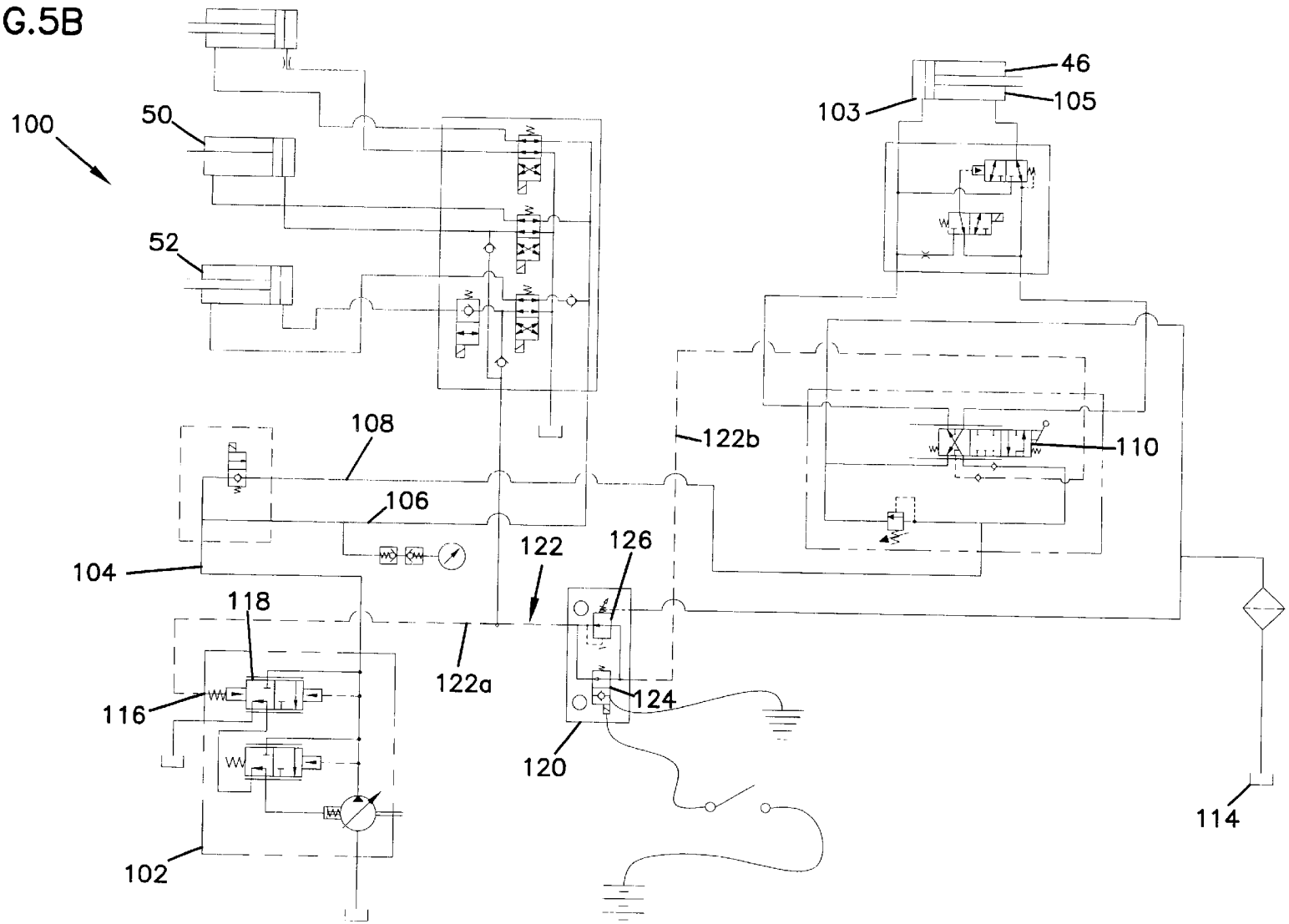
FIG. 5*b* shows the thrust limiting configuration of FIG. 5*a* with pressure being applied to the hydraulic cylinder and the thrust limiter deactivated.
Figure 5C:
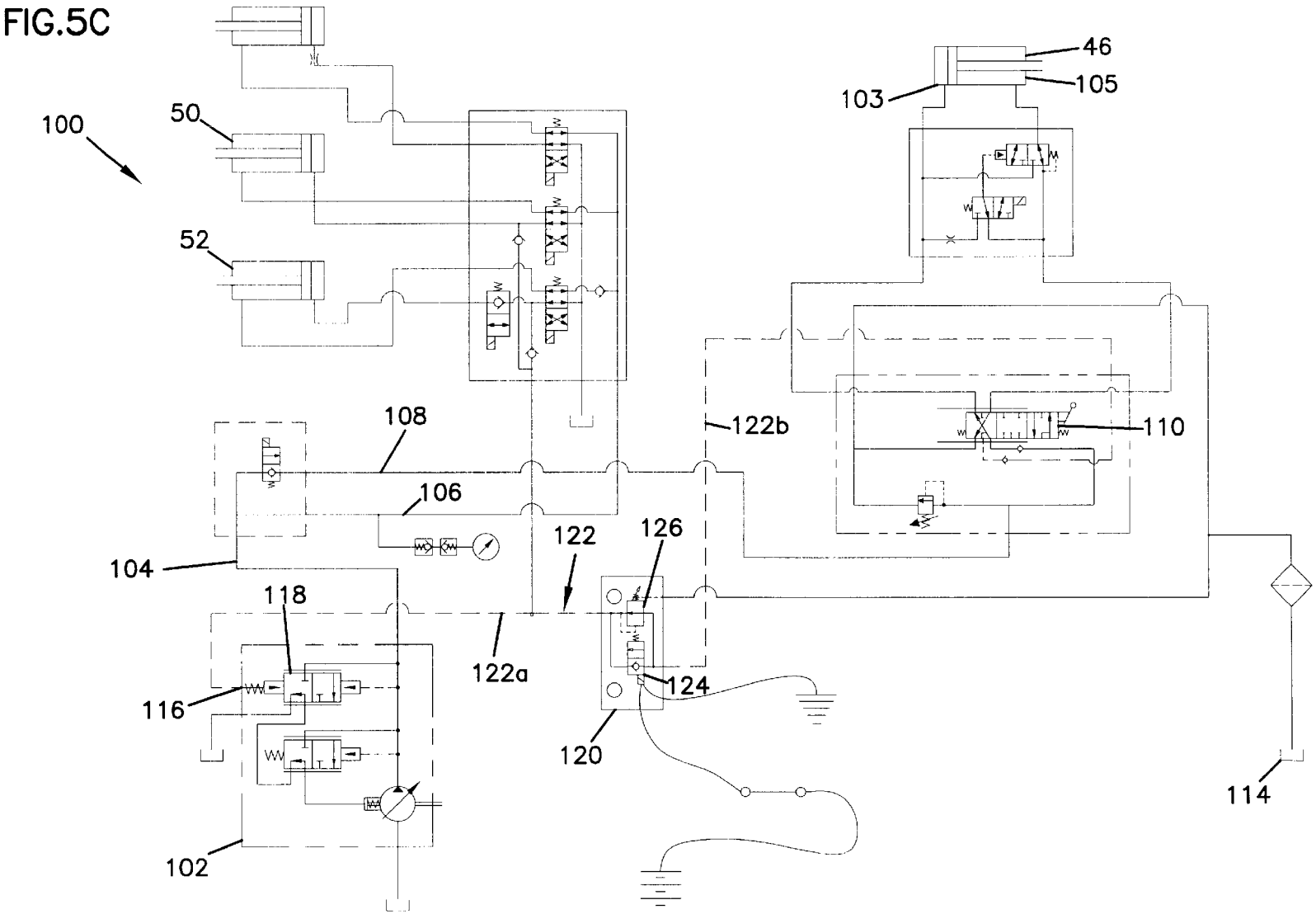
FIG. 5*c* shows the thrust limiting configuration of FIG. 5*a* with pressure being applied to the hydraulic cylinder and the thrust limiter activated.

FIGS. 5*a*–5*c* illustrate a thrust eliminating configuration 100 constructed in accordance with the principles of the present invention. The thrust eliminating configuration 100 includes a pump 102 that provides hydraulic pressure to the gripping units 50 and 52, and also provides hydraulic pressure to the hydraulic cylinder 46 of the thrust mechanism 40 shown in FIG. 1. It will be appreciated that the pump 100 can be any type of conventional pump. One non-limiting type of pump that can be used is a hydrostatic pump. A pump that has been determined to be suitable is sold as model no. 70423RDH by Eaton Manufacturing of Eden Prairie, Minn.

The pump 102 of FIGS. 5*a*–5*c* has a pressure output line 104 having a branch 106 that provides pressure to the gripping units 50 and 52, and a branch 108 that provides pressure to the hydraulic cylinder 46. A three position solenoid valve 110 controls the pressure provided to the hydraulic cylinder 46 through the pressure line 108. As shown in FIG. 5*a*, the solenoid 110 is in a middle position in which the solenoid valve 110 prevents pressure from reaching the cylinder 46. In FIGS. 5*b* and 5*c*, the solenoid valve 110 is shown moved to a right position in which the valve causes pressure to be directed to a first port 103 of the cylinder 46 to cause the cylinder piston to extend. The solenoid 110 can also be oriented in a left position (not shown) where the solenoid directs pressure from the pump 102 to the second port 105 to retract the piston of the cylinder 46. When the piston is being retracted or extended, the valve 110 opens fluid communication between the cylinder 46 and a reservoir 114.

The pump 102 includes a port 116 for use in limiting the output pressure of the pump 102. When no pressure is applied to the port 116, the pump outputs a pressure equal to a standby pressure (e.g., 400 psi) that is provided by a spring biased against solenoid 118. When a pressure is applied to the port 116, the pump outputs a pressure equal to the sum of the standby pressure and the pressure applied to the port 116. Thus, if a 1400 psi pressure is applied to the port 116, the pump will output a pressure of 1800 psi.

The thrust limiting configuration 100 also includes a thrust limiter 120 positioned along a pressure line 122 that extends from the valve 110 to the port 116 of the pump 102. The pressure line 122 includes a first portion 122*a* positioned between the thrust limiter 120 and the port 166, and a second portion 122*b* positioned between the thrust limiter 120 and the valve 110. When the valve 110 is in either of the left or right positions, the pressure line 122 is in fluid communication with the pressure line 108 that provides pressure to the cylinder 46.

The pressure limiter 120 includes a solenoid valve 124 positioned in parallel with a pressure reducing valve 126. The solenoid valve 124 is moveable between an open position (shown in FIGS. 5*a* and 5*b*) and a closed position shown in FIG. 5*c*. When the valve 124 is open, the valve 124 allows the pressure applied to the cylinder 46 by the pump 102 to bypass the pressure reducing valve 126 and be applied directly to the port 116. Thus, with the valve 124 open, the pressure provided to the cylinder 46 can progressively increase until the pump 102 reaches its maximum pressure capacity (e.g., 3000 psi).

The thrust limiter 120 is activated by closing valve 124 as shown in FIG. 5*c*. With the valve 124 closed, pressure in the line 122 is routed through the pressure reducing valve 126. The pressure reducing valve 126 can be set to a desired pressure limit. Pressure will continue to be routed through the pressure reducing valve 126 until the pressure reaches the preset pressure limit. When the preset pressure limit is reached, pressure in line 122*a* causes the pressure reducing valve 126 to close such that pressure in the line 122*a* is prevented from increasing further. Thus, the pressure output by the pump 102 is limited to a value equal to the standby pressure of valve 118 plus the pressure limit set by the pressure reducing valve 126. As long as the pressure in line 122*b* exceeds the pressure limit value set by the pressure reducing valve 126, the pressure reducing valve 126 will remain closed. However, if the pressure in line 122*b* falls below the pressure limit set by the pressure reducing valve 126, pressure within line 122*a* travels through the valve 124 to equalize the pressure. Thus, the pressure in line 122*a* will fall below the preset limit of the pressure reducing valve causing the pressure reducing valve to move to the open position. Pressure setting of valve 126 can be accomplished with a mechanical adjustment of a valve or electronically with a pulse width modulated valve.

The above-described configuration 100 allows an operator to selectively activate and deactivate the thrust limiter 120 depending upon the drilling environment. For example, during straight drilling, it may be desirable to deactivate the pressure limiter 120 such that a maximum pressure of the pump can be provided to the cylinder 46. By contrast, during activity such as steering, the operator can activate the thrust limiter 120 such the maximum pressure that can be provided to the cylinder 46 is limited to a value less than the maximum capacity of the pump. It will be appreciated that the activation/de-activation process can be done automatically by an electronic controller. In the embodiment shown, the limited pressure would be equal to the sum of the standby pressure of the pump 102 and the pressure limit value set at the pressure reducing valve 126.

It will be appreciated that thrust typically has a direct relation to torque except in certain situations in which the drill bit becomes caught. Therefore, in certain embodiments, the torque provided to the drill string can be limited or controlled by controlling or limiting the thrust applied to the drill string. For example, to assist in preventing the unintentional breaking of joints during a drilling sequence, thrust can be limited (e.g., by activating a thrust limiter) when the drill string is rotated in a reverse direction, and not limited (e.g., by deactivating a thrust limiter) when the drill string is rotated in a forward direction. The activation and deactivation of the thrust limiter can be manually controlled, or automatically controlled by means such as an electronic controller.

VII. Overall System Schematic

Figure 6:
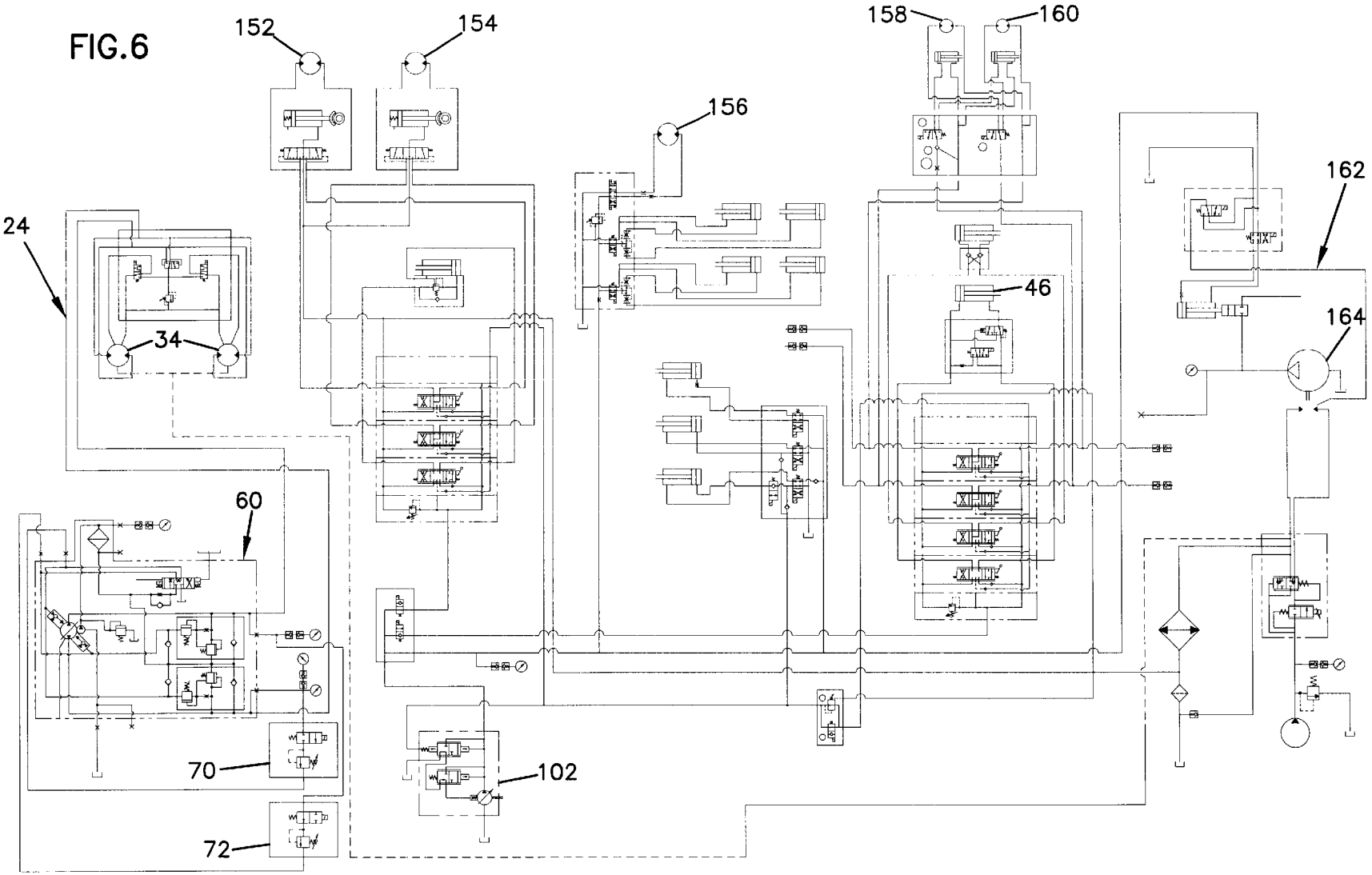
FIG. 6 is a hydraulic diagram of a system incorporating the systems of FIGS. 3*a* and 3*b*, and FIGS. 5*a* and 5*b*.

FIG. 6 shows an overall hydraulic system schematic suitable for use with the drilling machine 10 of FIG. 1. As shown in the schematic, pump 66 provides pressure to the motors 34 of the rotational driver 24. Torque limiters 70 and 72 can be activated and deactivated to limit the forward and reverse torque provided to the motors 34 by the pump 66. The schematic also shows that the pump 102 is used to pressurize left and right track drives 152 and 154 of the drilling machine 10, a rod loader 156 of the drilling machine, left and right stake down or anchoring devices 158 and 160, and the thrust cylinder 46. The thrust limiter 120 can be manually or automatically activated and deactivated to selectively control or limit the pressure applied to the cylinder 46 by the pump 102. The schematic also shows a water pumping system 162 including a water pump 164 for providing water pressure used during drilling operations.

With regard to the forgoing description, it is to be understood that changes may be made in detail, especially in matters of the construction materials employed and the size, shape and arrangement of the parts without departing from the scope of the present invention. For example, while relief valves were disclosed for limiting torque, other structures such as pressure reducing valves could also be used. Similarly, relief valve configurations could be used for limiting thrust. Further, mechanical adjustments of pressure settings can be accomplished with electronic controls and pulse width modulation techniques. Moreover, appropriate valve settings can be automated and may be responsive to different types of drilling/soil conditions as described in commonly assigned U.S. patent application Ser. No. 09/405,889, entitled REAL-TIME CONTROL SYSTEM AND METHOD FOR CONTROLLING AN UNDERGROUND BORING MACHINE, which is hereby incorporated by reference. It is intended that these specific and depicted aspects be considered exemplary only, with a true scope and spirit of the invention be indicated by the broad meaning of the following claims.

We claim:

1. A horizontal drilling machine for directionally drilling a drill string into the ground, the drill string including a plurality of elongated members connected end to end, the drilling machine comprising:

a track;

a rotational driver for rotating the drill string in forward and reverse directions about a longitudinal axis of the drill string;

a thrust mechanism for propelling the rotational driver along the track;

a first torque limiter that prevents the rotational driver from applying a forward torque to the drill string that exceeds a first torque limit; and a second torque limiter that prevents the rotational driver from applying a reverse torque to the drill string that exceeds a second torque limit, the second torque limit being less than the first torque limit.

2. The drilling machine of claim 1, wherein the second torque limit is at most 60 percent of the first torque limit.

3. The drilling machine of claim 1, wherein the first torque limit is equal to a makeup torque used to couple the elongated members together, and the second torque limit is less than a breakout torque required to uncouple the elongated members.

4. The drilling machine of claim 1, further comprising a thrust limiter than limits the thrust that can be applied to the drill string by the thrust mechanism, the thrust limiter limiting the thrust to a thrust value that is less than a maximum thrust value of the thrust mechanism.

5. The drilling machine of claim 4, wherein the thrust limiter can be manually activated and deactivated.

6. The drilling machine of claim 1, wherein the first torque limiter is normally deactivated.

7. The drilling machine of claim 6, wherein the first torque limiter is automatically activated when two elongated members are being coupled together.

8. The drilling machine of claim 1, wherein the second torque limiter is normally activated.

9. The drilling machine of claim 8, wherein the second torque limiter is automatically deactivated when two elongated members are being uncoupled.

10. The drilling machine of claim 1, further comprising an antirotation unit moveable between a first position is which the antirotation unit is adapted to prevent an engaged one of the elongated members from rotating, and a second position in which the antirotation unit is disengaged from the drill string.

11. The drilling machine of claim 10, wherein when the antirotation unit is moved to the first position, the first torque limiter is automatically activated, and the second torque limiter is automatically deactivated.

12. The drilling machine of claim 10, further comprising a switching mechanism for activating the first torque limiter and deactivating the second torque limiter when the antirotation unit is moved to the first position.

13. The drilling machine of claim 12, wherein the switching mechanism deactivates the first torque limiter and activates the second torque limiter when the antirotation unit is moved to the second position.

14. The drilling machine of claim 13, wherein the switching mechanism includes pilot activated valves that interface with the antirotation unit.

15. The drilling machine of claim 13, wherein the switching mechanism includes electronically actuated valves.

16. The drilling machine of claim 1, wherein the rotational driver includes a motor powered by a pump, wherein a reverse torque pressure line and a forward torque pressure line provide fluid communication between the pump and the motor, wherein the pump includes pump output limiting ports corresponding to each of the reverse torque pressure line and the forward torque pressure line, wherein a forward torque limiting pressure line extends from the forward torque pressure line to one of the ports and a reverse torque limiting pressure line extends from the reverse torque pressure line to the other port, and wherein valves for controlling the pressure applied to the ports are provided along the forward torque limiting pressure line and the reverse torque limiting pressure line.

17. The drilling machine of claim 16, wherein the valves comprise relief valves that open the forward torque limiting pressure line or the reverse torque limiting pressure line when a pressure output by the pump reaches a predetermined level.

18. The drilling machine of claim 17, further comprising valves positioned upstream from the relief valves for activating and deactivating the torque limiters.

19. A horizontal drilling machine for directionally drilling a drill string into the ground, the drill string including a plurality of elongated members threaded together end to end, the drilling machine comprising:

a track;

a rotational driver for rotating the drill string in forward and reverse directions about a longitudinal axis of the drill string, the drill string being rotated in the forward direction to thread the elongated members together, and the drill string being rotated in the reverse direction to unthread the elongated members from one another;

a thrust mechanism for propelling the rotational driver along the track; and a reverse torque limiter that prevents the rotational driver from applying a reverse torque to the drill string that exceeds a reverse torque limit, the reverse torque limiter being capable of being activated and deactivated, and the reverse torque limit being less than a maximum reverse torque that can be generated by the rotational driver when the reverse torque limiter is deactivated.

20. The drilling machine of claim 19, wherein the reverse torque limit is less than a makeup torque applied to the drill string to couple the elongated members together.

21. The drilling machine of claim 20, wherein the reverse torque limit is at most 60 percent of the makeup torque.

22. The drilling machine of claim 19, further comprising a thrust limiter than limits the thrust that can be applied to the drill string by the thrust mechanism, the thrust limiter limiting the thrust to a thrust value that is less than a maximum thrust value of the thrust mechanism.

23. The drilling machine of claim 22, wherein the thrust limiter can be manually activated and deactivated.

24. The drilling machine of claim 1, wherein the reverse torque limiter is normally activated.

25. The drilling machine of claim 24, wherein the reverse torque limiter is automatically deactivated when two elongated members are being uncoupled.

26. The drilling machine of claim 19, further comprising an antirotation unit moveable between a first position is which the antirotation unit is adapted to prevent an engaged one of the elongated members from rotating, and a second position in which the antirotation unit is disengaged from the drill string.

27. The drilling machine of claim 26, wherein when the antirotation unit is moved to the first position, the reverse torque limiter is automatically deactivated.

28. The drilling machine of claim 27, further comprising a switching mechanism for deactivating the reverse torque limiter when the antirotation unit is moved to the first position.

29. The drilling machine of claim 28, wherein the switching mechanism activates the reverse torque limiter when the antirotation unit is moved to the second position.

30. The drilling machine of claim 19, wherein the rotational driver includes a motor powered by a pump, wherein a reverse torque pressure line provides fluid communication between the pump and the motor, wherein the pump includes pump an output limiting port corresponding to the reverse torque pressure line, wherein a reverse torque limiting pressure line extends from the reverse torque pressure line to the port, and wherein a first valve for controlling the pressure applied to the ports is provided along the reverse torque limiting pressure line.

31. The drilling machine of claim 30, wherein the first valve comprises a relief valve that opens the reverse torque limiting pressure line when a pressure output by the pump reaches a predetermined level.

32. The drilling machine of claim 31, further comprising a second valves positioned upstream from the relief valve for activating and deactivating the reverse torque limiter.

33. A horizontal drilling machine for directionally drilling a drill string into the ground, the drill string including a plurality of elongated members threaded together end to end, the drilling machine comprising:

a track;

a rotational driver for rotating the drill string in forward and reverse directions about a longitudinal axis of the drill string, the drill string being rotated in the forward direction to thread the elongated members together, and the drill string being rotated in the reverse direction to unthread the elongated members from one another;

a thrust mechanism for propelling the rotational driver along the track; and a thrust limiter that prevents the thrust mechanism from applying a thrust load to the drill string that exceeds a thrust load limit, the thrust limiter being capable of being activated and deactivated, and the thrust load limit being less than a maximum thrust load that can be generated by thrust mechanism when the thrust limiter is deactivated.

34. A method for directionally drilling a drill string into the ground, the drill string including a plurality of elongated members, the method comprising:

threading the elongated members together by applying forward torque to the elongated members;

pushing the drill string into the ground;

rotating the drill string in forward and reverse directions by applying forward and reverse torque to the drill string in an alternating fashion while thrust concurrently is applied to the drill string; and automatically limiting the reverse torque applied to the drill string in the previous step to a value less than a break out torque required to uncouple the elongated members.

35. A method for directionally drilling a drill string into the ground, the drill string including a plurality of elongated members, the method comprising:

activating a reverse rotation torque limiter;

pushing the drill string into the ground; and rotating the underground drill string in forward and reverse directions by applying forward and reverse torque to the drill string in an alternating fashion while the reverse rotation torque limiter is concurrently activated, wherein the reverse rotation torque limiter limits the reverse torque applied to the drill string to a value less than a break out torque required to uncouple the elongated members.

36. The method of claim 35, further comprising deactivating the reverse rotation torque limiter when it is desired to uncouple the elongated members.

* * * * *